US007867064B2

(12) United States Patent
Field et al.

(10) Patent No.: US 7,867,064 B2
(45) Date of Patent: Jan. 11, 2011

(54) DRYWALL SANDER

(75) Inventors: Craig M. Field, Traunik, MI (US); Jeffrey L. Trudeau, Marquette, MI (US)

(73) Assignee: EC Sander, L.L.C., Traunik, MI (US)

( * ) Notice: Subject to any disclaimer, the term of this patent is extended or adjusted under 35 U.S.C. 154(b) by 0 days.

(21) Appl. No.: 12/239,152

(22) Filed: Sep. 26, 2008

(65) Prior Publication Data

US 2009/0023370 A1 Jan. 22, 2009

Related U.S. Application Data

(62) Division of application No. 11/636,185, filed on Dec. 8, 2006, now Pat. No. 7,497,765.

(60) Provisional application No. 60/748,781, filed on Dec. 9, 2005.

(51) Int. Cl.
*B23B 23/00* (2006.01)

(52) U.S. Cl. ..... 451/344; 451/354

(58) Field of Classification Search ..... 451/344, 451/354

See application file for complete search history.

(56) References Cited

U.S. PATENT DOCUMENTS

| | | | | |
|---|---|---|---|---|
| 2,493,505 | A | 1/1950 | Schueller | |
| 2,817,931 | A | 12/1957 | Houser | |
| 2,983,944 | A | 5/1961 | Uselis | |
| 3,073,084 | A | 1/1963 | Howard | |
| 3,123,946 | A | 3/1964 | Hoveland | |
| 3,192,678 | A | 7/1965 | Buratti | |
| 3,279,130 | A | 10/1966 | Nelson | |
| 3,483,662 | A | 12/1969 | Ames | |
| 3,488,897 | A | 1/1970 | Taafe, Jr. | |
| 3,540,160 | A | 11/1970 | Rose et al. | |
| 3,653,859 | A | 4/1972 | Zimmer, Jr. et al. | |
| 4,202,139 | A | 5/1980 | Hong et al. | |
| 4,221,084 | A | 9/1980 | Frantzen | |
| 4,330,964 | A | 5/1982 | Martinez | |
| 4,484,419 | A | 11/1984 | Freerks | |
| 4,516,361 | A | 5/1985 | Gringer | |
| 4,825,597 | A | 5/1989 | Matechuk | |
| 4,885,876 | A | 12/1989 | Henke | |
| 4,922,665 | A | 5/1990 | Wanatowicz | |
| 5,054,248 | A | 10/1991 | Thayer | |
| 5,309,681 | A | 5/1994 | Cheney et al. | |
| 5,313,746 | A | 5/1994 | Zarriello | |
| 5,337,523 | A | 8/1994 | Walsh | |
| 5,605,500 | A * | 2/1997 | Matechuk | 451/456 |

(Continued)

OTHER PUBLICATIONS

International Search Report dated Aug. 25, 2008, PCT Application No. PCT/US07/70592, Filing Date Jun. 7, 2007 (2 pages).

*Primary Examiner*—Maurina Rachuba
(74) *Attorney, Agent, or Firm*—Price, Heneveld, Cooper, DeWitt & Litton, LLP

(57) ABSTRACT

A drywall sander includes a replaceable sanding pad having a layer of resilient material, and an abrasive surface. The sanding pad includes one or more edge portions that project beyond the edges of a sander head. The edges of the sanding pad can be deformed during use when the sander is used in a corner or the like to thereby prevent scuffing or other damage to adjacent orthogonal surfaces.

23 Claims, 12 Drawing Sheets

U.S. PATENT DOCUMENTS

| | | | | |
|---|---|---|---|---|
| 5,634,843 | A | 6/1997 | Liu | |
| 5,651,728 | A | 7/1997 | Stanzione | |
| 5,662,519 | A | 9/1997 | Arnold | |
| 5,902,176 | A | 5/1999 | Chen | |
| 5,954,571 | A | 9/1999 | Case | |
| 6,095,911 | A | 8/2000 | Edens | |
| 6,227,959 | B1 * | 5/2001 | Beaudry | 451/526 |
| 6,267,658 | B1 | 7/2001 | Ali et al. | |
| 6,325,708 | B1 | 12/2001 | Miles | |
| 6,419,573 | B1 | 7/2002 | Lise et al. | |
| 6,439,983 | B1 | 8/2002 | McCoy et al. | |
| 6,439,988 | B1 | 8/2002 | Long et al. | |
| 6,524,175 | B2 | 2/2003 | Beaudry et al. | |
| 6,613,113 | B2 | 9/2003 | Minick et al. | |
| 6,991,529 | B2 | 1/2006 | Annis et al. | |
| 7,182,681 | B2 | 2/2007 | Kirschhoffer et al. | |
| 7,220,172 | B2 | 5/2007 | Kirschhoffer et al. | |
| 2004/0259488 | A1 | 12/2004 | McArthur et al. | |
| 2007/0037500 | A1 | 2/2007 | Minick et al. | |

* cited by examiner

DRYWALL SANDER

CROSS REFERENCE TO RELATED APPLICATIONS

The present application is a division of U.S. patent application Ser. No. 11/636,185, filed Dec. 8, 2006, which claims the benefit of U.S. Provisional Application No. 60/748,781, entitled DRYWALL SANDER, filed on Dec. 9, 2005, the entire contents of each of which are hereby incorporated by reference.

BACKGROUND OF THE INVENTION

Various types of sanders for sanding drywall and the like have been developed. Drywall sanders typically include a rectangular head that is pivotably attached to an elongated handle. The head includes clamps or the like for removably securing a piece of sandpaper to the sanding head.

Although known drywall sanders have been somewhat effective, they suffer from several disadvantages/drawbacks. For example, available sandpaper for such sanders may tear relatively easily during use, thereby requiring that the user stop sanding and replace the sandpaper. Also, existing sandpaper tends to become loaded up quickly, thereby reducing the effectiveness of the sandpaper. Once the sandpaper becomes loaded up, it must be replaced. The need to frequently replace the sandpaper increases the amount of time required to complete a job, and also adds to the cost of materials.

Also, known drywall sanders may support the sandpaper in a way that makes it difficult to obtain a surface having the desired smoothness. Furthermore, the edges of the sander head may come into contact with other wall surfaces when sanding in corners. The sander head may also contact mouldings, door and window frames, and the like. This contact may scratch or cause other such damage to these surfaces.

Accordingly, a drywall sander alleviating the above-identified drawbacks of existing drywall sanders would be beneficial.

SUMMARY OF THE INVENTION

One aspect of the present invention is a drywall sander assembly including a unique replaceable sanding pad having a resilient foam layer and flexible extensions or wings that extend from opposite sides of the pad. The sander assembly includes a sanding head having a generally rectangularly-shaped body portion having opposed parallel side edges defining a first width, and spaced-apart opposite end edge portions defining a first length. The sanding head further includes releasable retainers adjacent to the end portions of the sanding head for retaining a flexible sanding member on the sanding head. The sanding head defines a first side having a generally flat end surface configured to support a flexible sanding member, and a second side opposite the first side. The drywall sander assembly further includes an elongated handle member having a first end that is pivotally connected to the sanding head. The elongated handle extends away from the second side of the sanding head such that the angular position of the handle relative to the head can be changed when a user is sanding a wall or the like.

The replaceable sanding pad or member defines a generally quadrilateral perimeter having end portions defining a second length that is greater than the first length. The perimeter has opposite side edges defining a second width that is greater than the first width. The replaceable sanding member has a layer of resilient foam defining first and second opposite sides, and includes abrasive material on the first side thereof. The end portions of the replaceable sanding member wrap around the end portions of the body of the sanding head. The releasable retainer is engaged to the end portions of the sanding member to retain the sanding member on the sanding head. The replaceable sanding member includes opposite side edge portions that project beyond the side edges of the body portion of the sanding head to define resilient wings having a first shape when the resilient wings are not in contact with an object other than the sanding head. In use, the resilient wings deform to a second shape that is different from the first shape upon contact with an object. The resilient wings return to the first shape when the resilient wings are no longer in contact with an object.

In the foregoing description, it will be readily appreciated by those skilled in the art that modifications may be made to the invention without departing from the concepts disclosed herein. Such modifications are to be considered as included in the following claims, unless these claims by their language expressly state otherwise.

DETAILED DESCRIPTION OF PREFERRED EMBODIMENT

Figure 1:
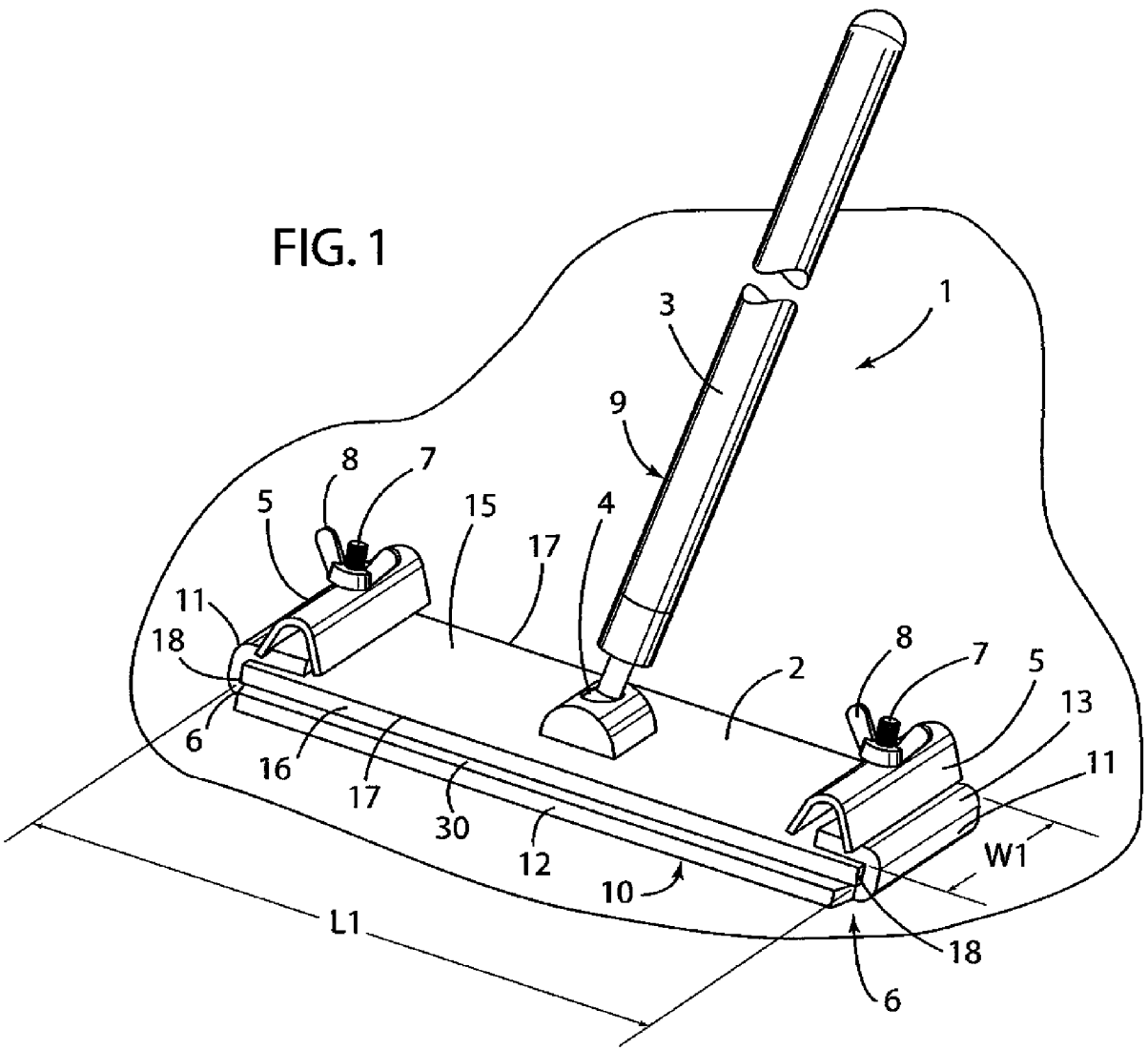
FIG. 1 is a partially fragmentary isometric view of a drywall sander assembly according to one aspect of the present invention.

For purposes of description herein, the terms "upper," "lower," "right," "left," "rear," "front," "vertical," "horizontal," and derivatives thereof shall relate to the invention as oriented in FIG. 1. However, it is to be understood that the invention may assume various alternative orientations and step sequences, except where expressly specified to the contrary. It is also to be understood that the specific devices and processes illustrated in the attached drawings and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

Figure 2:
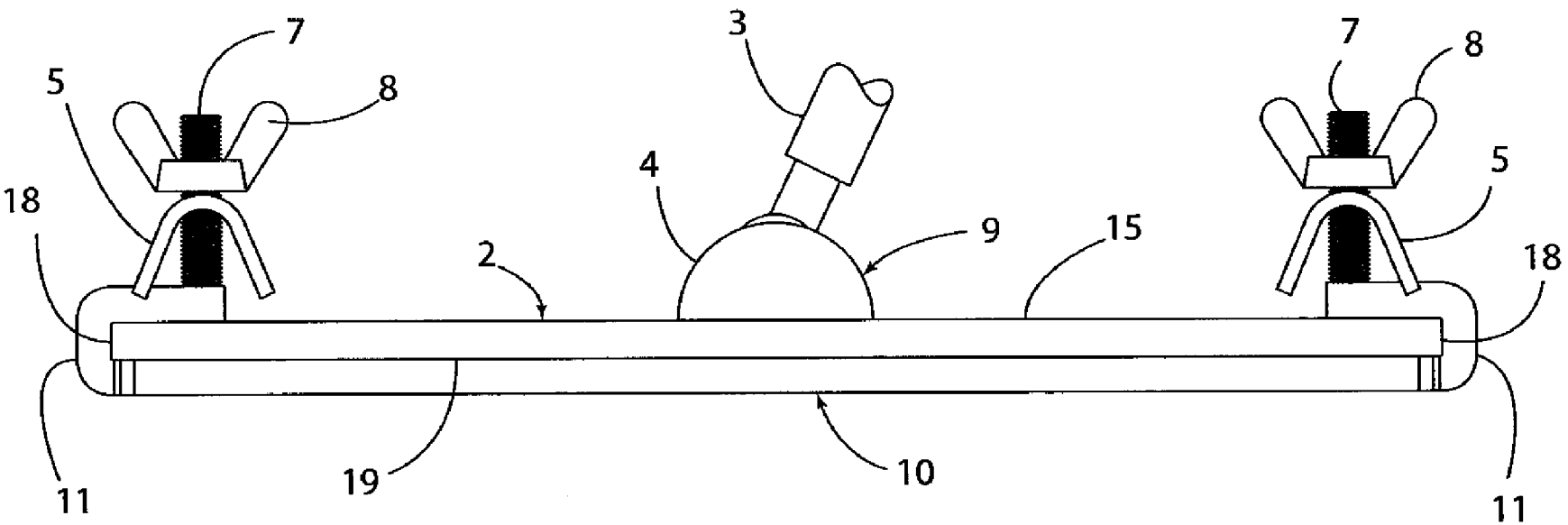
FIG. 2 is a front elevational view of a portion of the drywall sander of FIG. 1.
Figure 7:
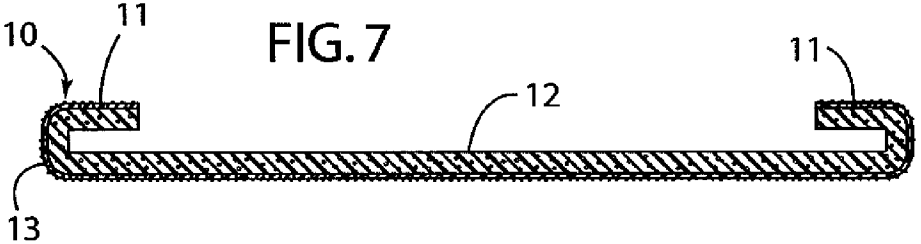
FIG. 7 is a cross-sectional view of the sanding member of FIG. 5 taken along the line VII-VII.
Figure 6:
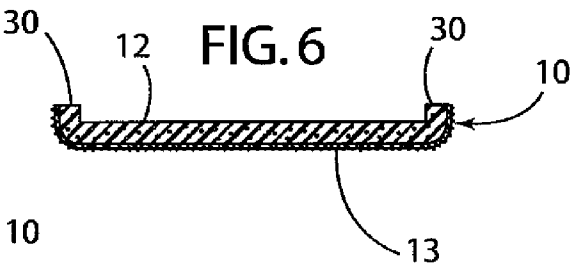
FIG. 6 is a cross-sectional view of the sanding member of FIG. 5 taken along the line VI-VI.

With reference to FIG. 1, a drywall sander 1 according to one aspect of the present invention includes a drywall sander 9 of a known design, with a unique replaceable sanding pad 10 attached thereto. Sander 9 includes a head 2, and an elongated handle 3 that is pivotably connected to the head 2 by a pivotable connector 4. A pair of clamp members 5 of sander 9 are connected to the opposite end portions 6 of head 2 by threaded studs 7 and wing nuts 8. As described in more detail below, a unique replaceable sanding pad 10 includes a layer of resilient foam material 12 (see also FIGS. 6 and 7) and an outer abrasive surface 13. The combination of a layer of foam 12 and an abrasive outer surface 13 facilitates sanding irregular wall surfaces, inside corners of walls, and other objects such as door frames or the like protruding from the surface being sanded. End portions 11 of sanding pad 10 wrap around ends 6 of head 2, and clamps 5 engage end portions 11 to retain pad 10. The head 2 of sander 9 includes a body portion 15 having a generally rectangular perimeter 16 with opposite side edges 17 and end edges 18. The end edges 18 define a length L1 of the body 15, and the opposite side edges 17 define a width W1. The sanding head 2 may include a layer of foam, rubber or the like that is permanently bonded to a lower side 19 (FIG. 2) of body portion 15. Sanding head 2 may be that of, for example, a Marshalltown Model 26 sander. This sanding head includes a rectangular metal portion having a width of about 3¼ inches, and a length of about 9⅜ inches. This sanding head also includes a rubber pad to cushion conventional sandpaper attached to the head. The rubber pad has initial dimensions (when new) of about 3⁵⁄₁₆ (or 3⅜ inches) inches by about 9⅛ inches. However, after a period of use, the edges of the rubber pad tend to wear down until the width of the rubber pad is the same as the metal portion of the sanding head. It will be understood that the head 2, handle 3, pivotable connection 4, and clamp members 5, as well as threaded studs 7 and wing nuts 8 comprise an existing prior art drywall sander 9. Accordingly, these components will not be described in further detail herein. Also, it will be understood that other types of known drywall sanding heads and clamping/sandpaper securing arrangements are known. The inventive replaceable sanding head 10 may be used with virtually any such known drywall sanders.

Figure 3:
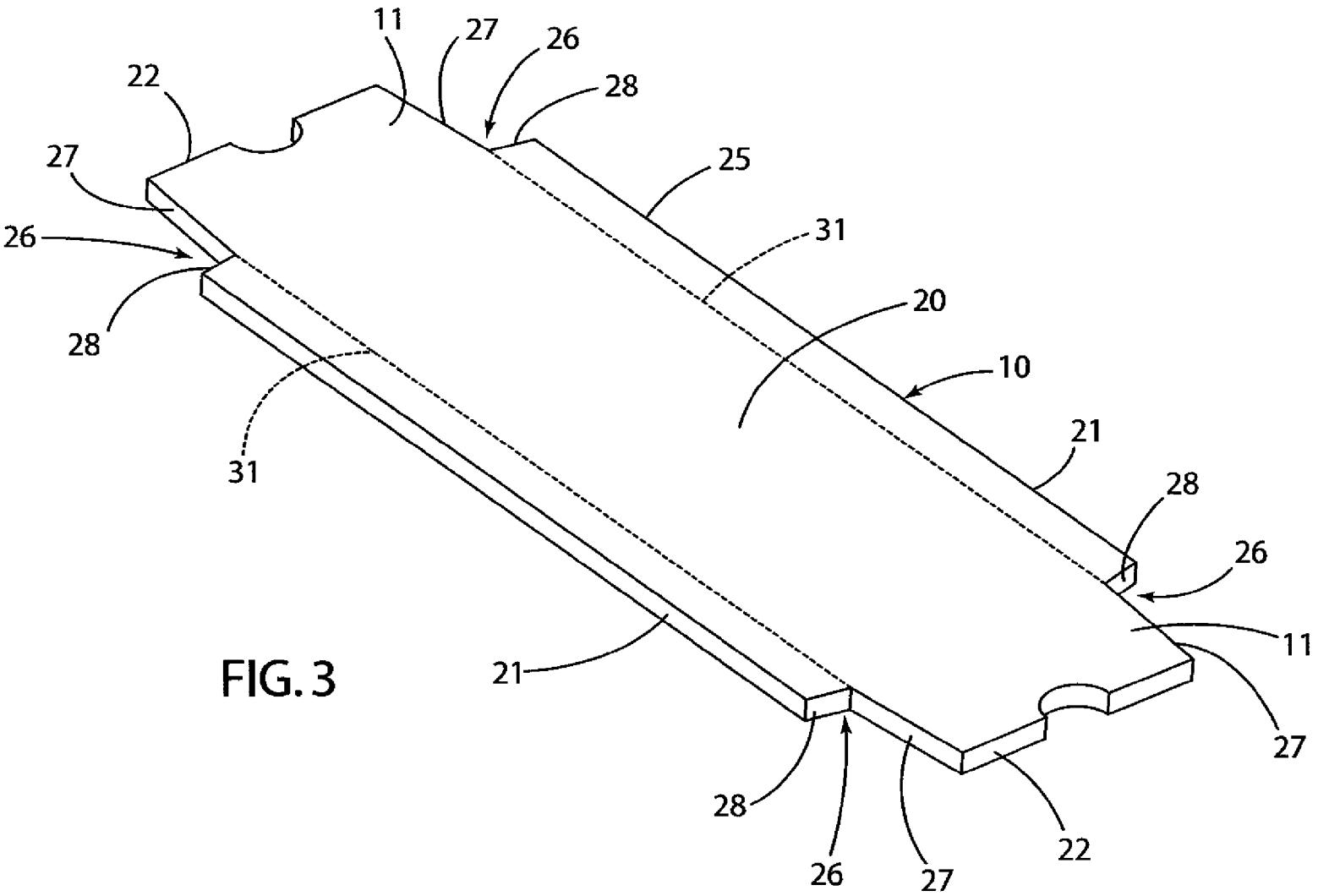
FIG. 3 is an isometric view of a replaceable sanding member according to one aspect of the present invention.
Figure 4:
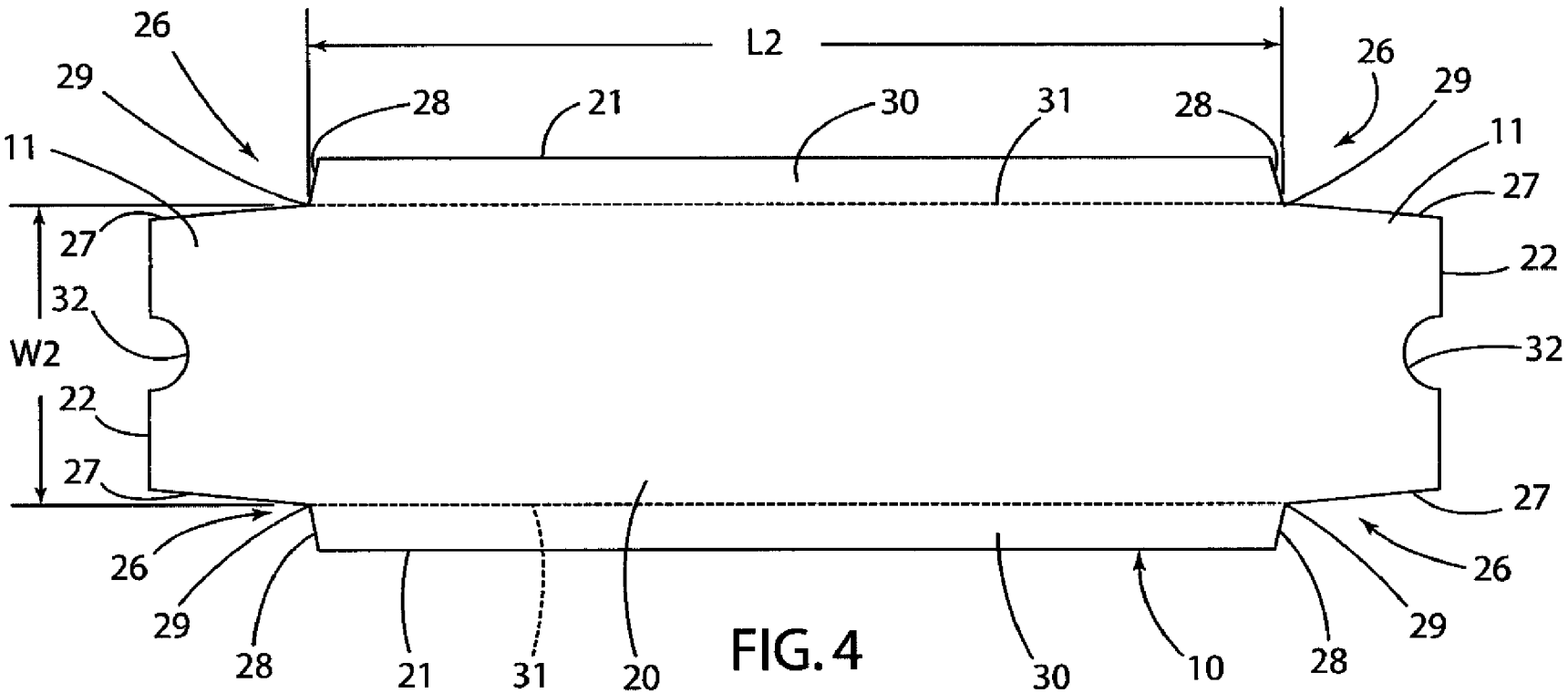
FIG. 4 is a plan view of the sanding member of FIG. 3.

The sanding pad 10 includes a central portion 20 (FIG. 3), and a peripheral edge 25 including opposite side edges 21 that are generally parallel to one another. The peripheral edge or perimeter 25 is generally rectangular, with end edges 22 and notched corners 26. Notched corners 26 define first and second edge portions 27 and 26, respectively, that intersect to define a corner 29. Edge portions 27 are approximately parallel to opposite side edges 21, and second edge portions 28 are transverse to the opposite side edges 21. In the illustrated example, the first edge portions 27 extend towards one another, forming an angle of about five degrees (5°) relative to the opposite side edges 21. Also, the second edge portions 28 are angled about ten degrees (10°) relative to the end edges 22, such that the angle between the edge portions 27 and 28 at corners 26 is about one hundred and five degrees (105°). The dimension "W2" between the corners 29 is about the same as the width W1 of head 2 (FIG. 1). Also, the length L2 (FIG. 4) between the corners 29 is approximately the same as the length L1 of head 2 (FIG. 1). End edges 22 of end portions 11 of pad 10 (FIG. 4) include a concave cutout 32 that provides clearance for threaded stud (FIG. 1) when pad 10 is installed to pad 2.

Dashed lines 31 extending between corners 29 represent the position of opposite side edges 17 of head 2 when sanding pad 10 is installed to the head 2. The area between dashed lines 31 and opposite edges 21 form "wings" or tabs 30 that project beyond the edges 17 of head 2 a distance equal to the distance between lines 31 and edges 21 when replaceable sanding pad 10 is installed to head 2. As described in more detail below, the wings or tabs 30 are resilient due to the foam layer 12 of sanding pad 10, and facilitate sanding corners formed by walls, mouldings, or other objects protruding from the surface being sanded. In the illustrated example, the distance between dashed lines 31 and edges 21 about ⅜ to ½ inch. However, the wings 30 could project as little as ⅛ inch (0.125 inch) or less, or as much as ¾ inch (0.750 inch) or more. As discussed above, the sanding head 2 includes a metal portion having a width of about 3¼ inches, and a rubber pad having a width of about 3⁵⁄₁₆ inches (when new). Thus, the total width of sanding pad 10 (i.e., dimension between edges 21) is preferably greater than 3⁵⁄₁₆ inches. In the illustrated example, the total width of sanding pad 10 is about 4⅙ to about 4⁵⁄₁₆ inches (i.e., 3⁵⁄₁₆ inches plus ⅜ to ½ inch). However, the pad 10 could have a width as small as 3⁷⁄₁₆ inches (the width of the metal portion of the sander head and rubber pad after it wears down is 3³⁄₁₆ inches plus two ⅛ inch wings 30) or as large as 4¹³⁄₁₆ inches (3⁵⁄₁₆ inches wide rubber pad on head 2, when new, plus two ¾ inch wings). The ends 11 of sanding pad 10 preferably provide enough length to wrap around end edges 18 of head 2. End portions 11 of pad 10 are preferably about an inch long, such that the total length of pad 10 is about two inches longer than head 2. However, end portions may be as small as ½ inch, ⅜ inch, or less.

Figure 8:
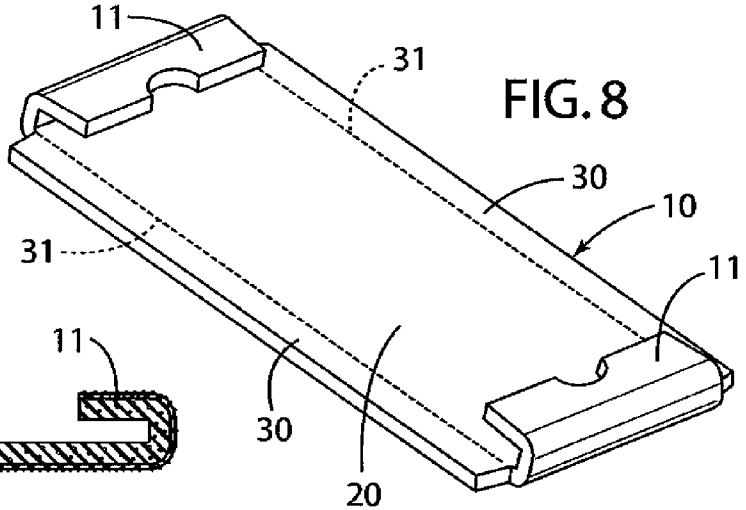
FIG. 8 is an isometric view of the sanding member showing the ends wrapped around, and the wings in a flat configuration.
Figure 5:
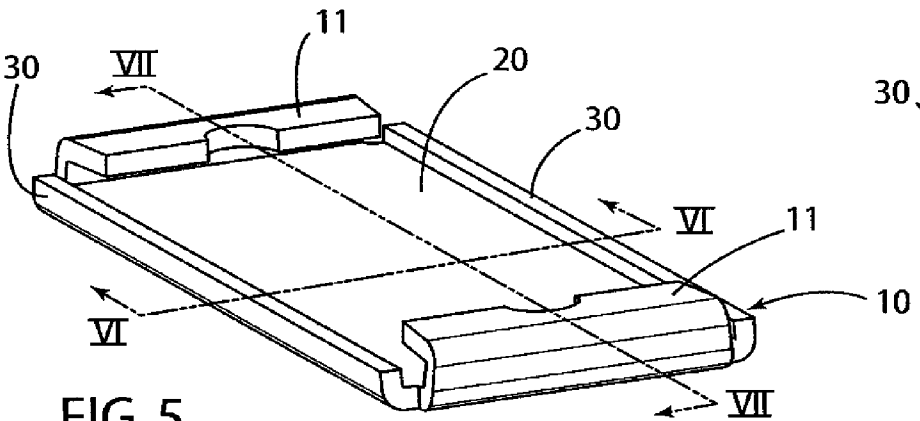
FIG. 5 is an isometric view of the sanding member of FIG. 3 showing the ends and wings in flexed/deformed configurations.

FIG. 5 shows the shape of end portions 11 of sanding pad 10 when installed to head 2. Wings 30 are shown in an upwardly-folded or deformed configuration (FIGS. 5 and 6) representing the shape that wings or tabs 30 would take if sanding pad 10 were installed to head 2, and the wings 30 were brought into contact with an object to thereby deform wings 30 so they abut opposite side edges 17 of head 2 (FIG. 1). However, it will be understood that wings 30 have a flat shape that is co-planar with the central portion 20 of sanding pad 10 as shown in FIG. 8 when wings 30 are in a free state such that they are not in contact with a protrusion or the like projecting from the surface being sanded. The end portions 11 of replaceable sanding pad 10 are configured to wrap around the opposite end portions 6 of pad 2, with clamp member 5 (FIG. 1) in engagement with the end portions 11 to thereby secure the replaceable pad 10 to the head 2 (see also FIG. 7).

In the illustrated example, the foam layer 12 is about ³⁄₁₆ inch (0.1875 inch) thick. However, the foam layer 12 may be as thin as ⁱ⁄₁₆ inch (0.0625 inch) (or less) thick, or as thick as one inch (1.0 inch). In the illustrated example, the foam layer 12 has a substantially uniform thickness. However, foam layer 12 could have varying thickness. For example, end portions 11 could be thinner to facilitate wrapping of the end portions 11 around the ends 6 of head 2. The foam layer 12 comprises a polymer foam such as a polyurethane or polyethylene foam. Although the type of foam material and the thickness of the foam may vary, the foam layer 12 preferably provides sufficient rigidity to insure that the wings 30 return to the flat configuration shown in FIGS. 1 and 8 when the wings 30 are not in contact with a protrusion or orthogonal wall surface. However, the foam layer 12 preferably has sufficient flexibility to permit the end portions 11 to be deformed to permit installation of sanding pad 10 to head 2. Also, the foam layer 12 has enough flexibility to permit the wings 30 to be deformed without application of excessive force when the wings 30 are brought into contact with an orthogonal wall surface at a corner, or an orthogonal surface of an object protruding from the wall surface being sanded. In the illustrated example, the abrasive surface 13 comprises 80 grit. Although this grit has proven to be effective, other grits forming an abrasive surface may also be utilized. For example, the abrasive surface 13 may have virtually any grit, and could comprise a grit as coarse as 36, or as fine as 220. In the illustrated example, the grit comprises aluminum oxide material. However, other abrasive surfaces that do not utilize conventional grit could also be utilized. Also, the sanding pad may include a layer of cloth or the like (not shown) between the foam material and the abrasive to increase the strength of the pad and thereby increase the useful life of the pad.

The replaceable sanding pad 10 provides numerous advantages over conventional sandpaper. For example, when sanding a drywall surface adjacent a vertical door moulding, the wings 30 will flex to thereby sand the door frame surfaces that are orthogonal to the drywall surface. The wings 30 also prevent damage or scuffing that could otherwise result from head 20 coming into contact with the door frame. Also, when sanding a corner formed by orthogonal drywall surfaces, the wings 30 flex upwardly, thereby permitting sanding into corners without scuffing or damaging either of the orthogonal wall surfaces. The wings 30 also flex to adapt to virtually any other corner configuration or the like that may be present.

Furthermore, the wings 30 provide extra stability for the sanding head 2, and thereby reduce the likelihood that the sanding head 2 will inadvertently flip or pivot about pivotable connector 4 when the sanding head 2 is being moved in a side-to-side direction (i.e., transverse to opposite edges 17). Similarly, the head 2 can be moved in a circular motion without flipping over. Also, the thickness of pad 10 spaces the head 2 from the surface being sanded. As discussed above, existing sanding heads 2 may include a rubber layer. If conventional sandpaper is used, the rubber layer may contact the surface being sanded, causing the sanding head to flip, especially if the surface is rough/irregular due to drywall tape or other surface irregularities. The sanding pad 10 spaces the rubber pad (not shown) of sanding head 10 from the surface being sanded, thereby preventing the rubber pad from contacting the surface being sanded and reducing or eliminating the tendency of the sanding head to flip. Thus, sanding pad 10 reduces the tendency of head 2 to flip both by increasing the effective width of the sanding head due to wings 30, and by eliminating or reducing the tendency for the head 2 to contact the surface being sanded.

Still further, when sanding a drywall surface directly adjacent an outside corner of a door frame or the like, one of the wings 30 can be brought into contact with the corner. The wing 30 will deform, and thereby sand the orthogonal outside surfaces of the door frame adjacent the corner while the central portion 20 of pad 10 is in contact with the drywall surface. When used in this way, the head 2 is generally positioned such that the opposite edges 17 are at about a 45 degree angle relative to the outer surfaces of the door frame being sanded. Yet another advantage of the sanding pad 10 is that the resilient nature of the foam layer 12 facilitates sanding of irregular surfaces, such that a user can more quickly provide a finished surface. Still further, the abrasive surface 13 is less prone to loading up during sanding, further enhancing the sanding process. Also, the pad 10 can be cleaned in water or other suitable fluid and reused. Thus, sanding pad 10 greatly facilitates sanding of drywall surfaces, and also substantially reduces the need to replace the sanding media compared to conventional sandpaper.

Figure 9:
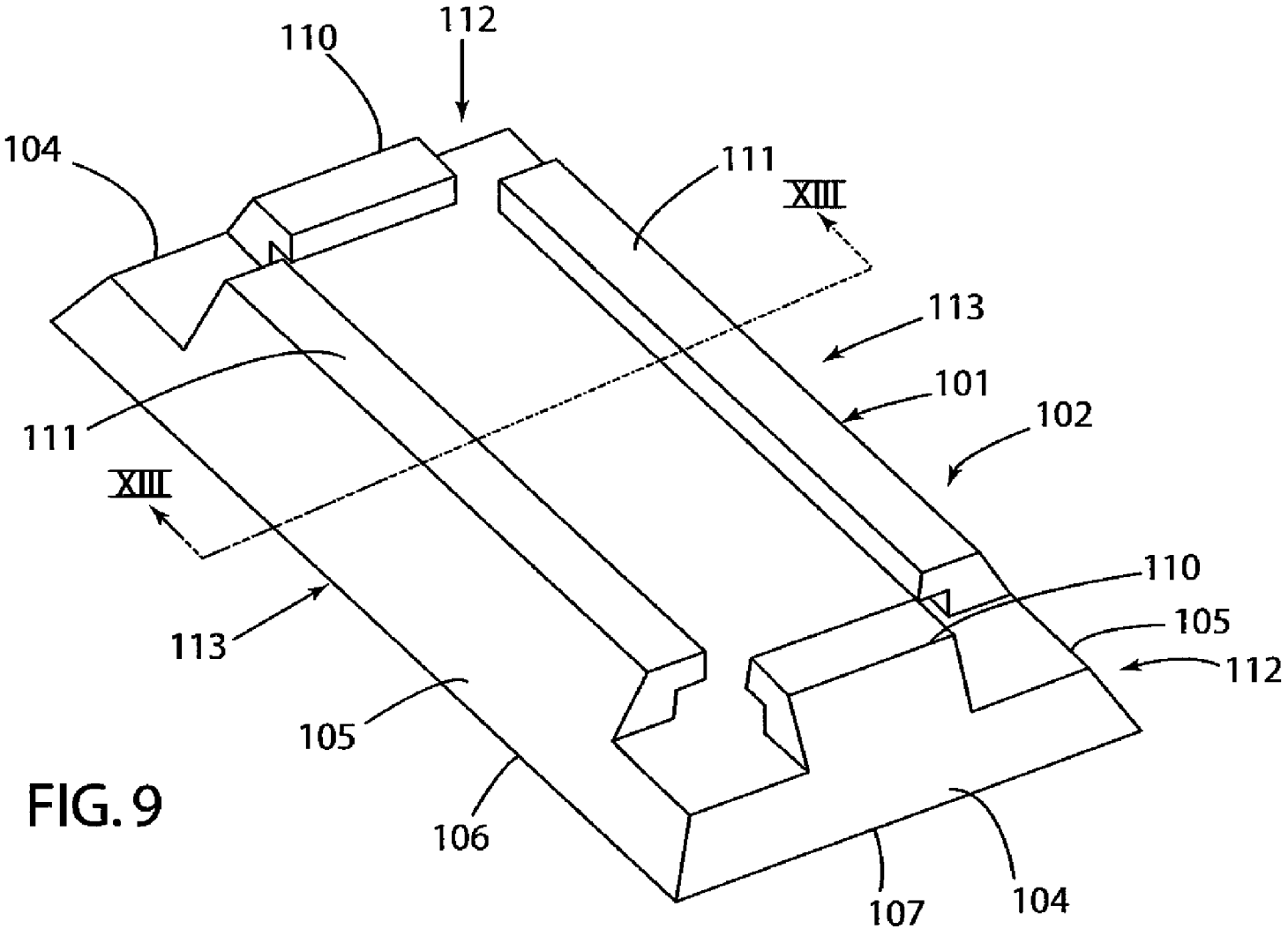
FIG. 9 is a perspective view of a drywall sander according to another aspect of the present invention.
Figure 10:
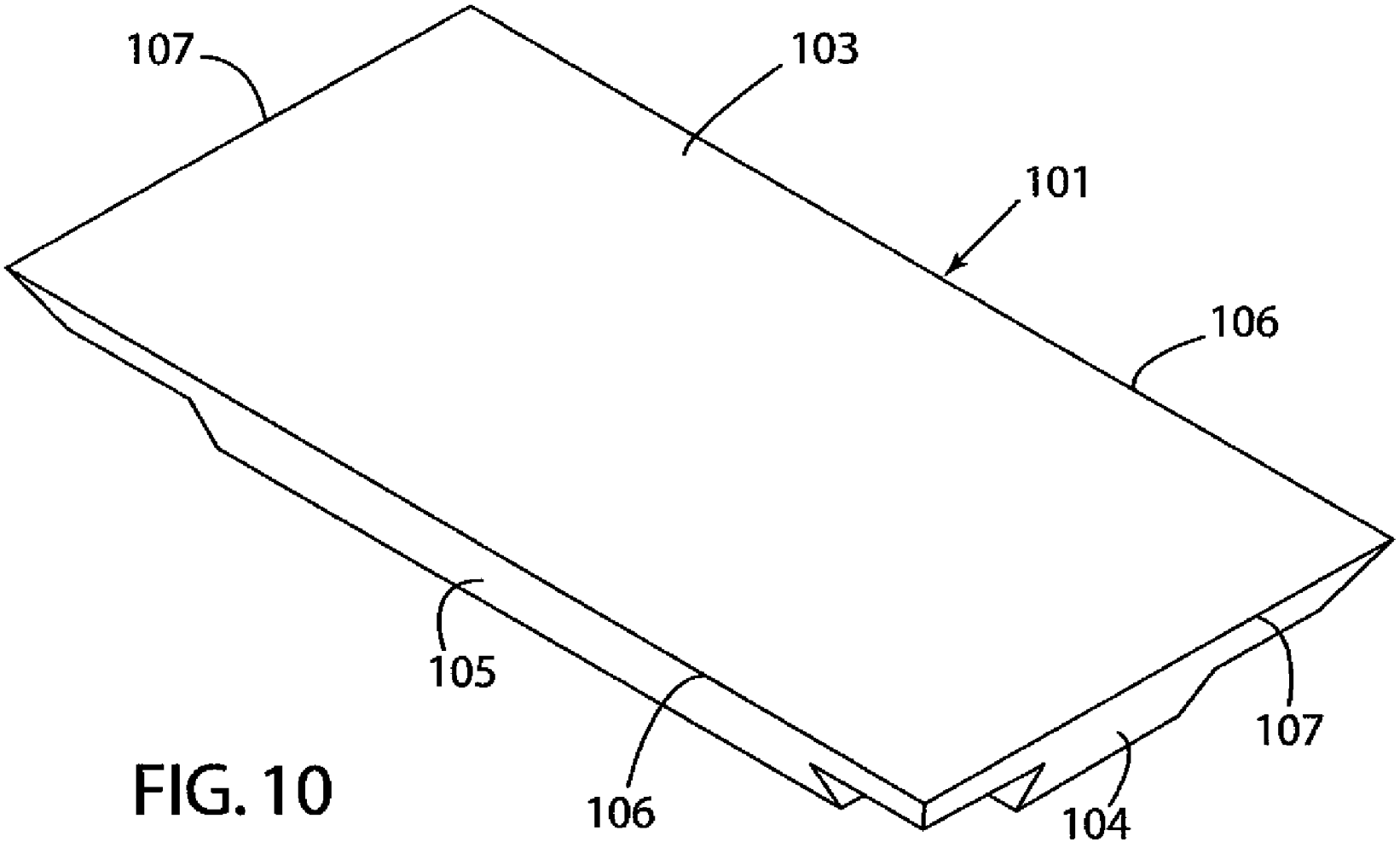
FIG. 10 is a perspective view of the drywall sander of FIG. 9 from a different angle.
Figure 11:
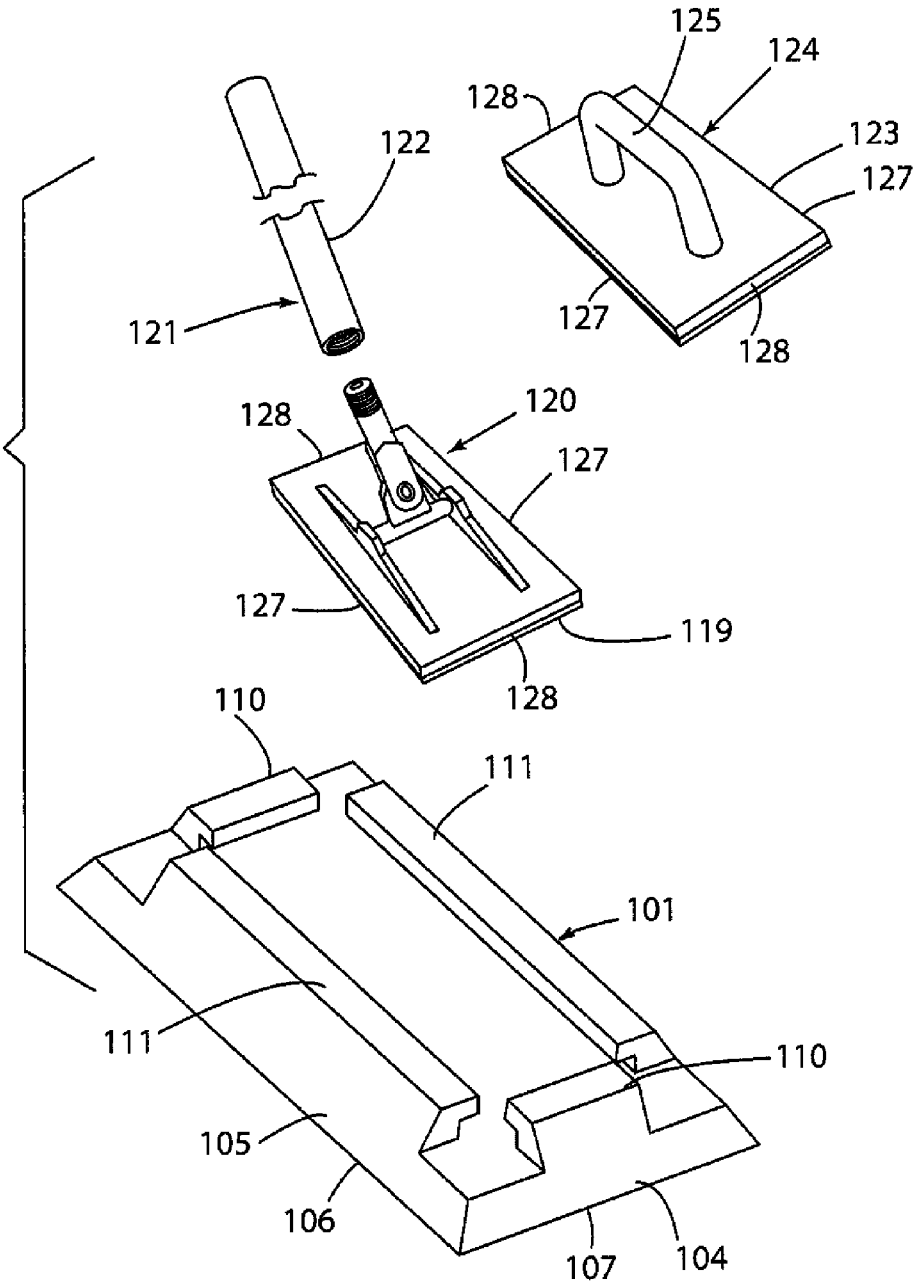
FIG. 11 is an exploded perspective view of the drywall sander of FIG. 9 and two examples of commercially available drywall sanding tools having rectangular sanding heads.

A drywall sander 101 (FIGS. 9 and 10) according to another aspect of the present invention includes a body 102 having a generally planar main surface 103 and side surfaces 104 and 105 that extend inwardly from the main surface at an acute angle $\alpha$ (FIG. 13) to form sharp edges 106 and 107. Although angle $\alpha$ is preferably an acute angle in the range of about forty-five degrees to about eighty-five degrees, and more preferably about sixty-five degrees, angle $\alpha$ may be ninety degrees, or it may be an obtuse angle. As discussed in more detail below, body 102 is made of a flexible foam material that is at least partially covered by abrasive material. The body 102 includes retaining tabs 110 at opposite ends 112 of body 102, and elongated retaining tabs 111 along opposite sides 113 of body 102. Retaining tabs 111 include an inwardly extending portion 114 defining opposed slots 115. It will be understood that the retaining tabs 110 have substantially the same shape as retaining tabs 111. With reference back to FIG. 11, the sander 101 may be connected to a rectangular head 120 of a commercially available drywall sander 121 having an elongated handle or pole 122. Alternately, the sander 101 may be secured to the rectangular plate-like portion 123 of a conventional drywall sander 124 having a handle 125.

Figure 12:
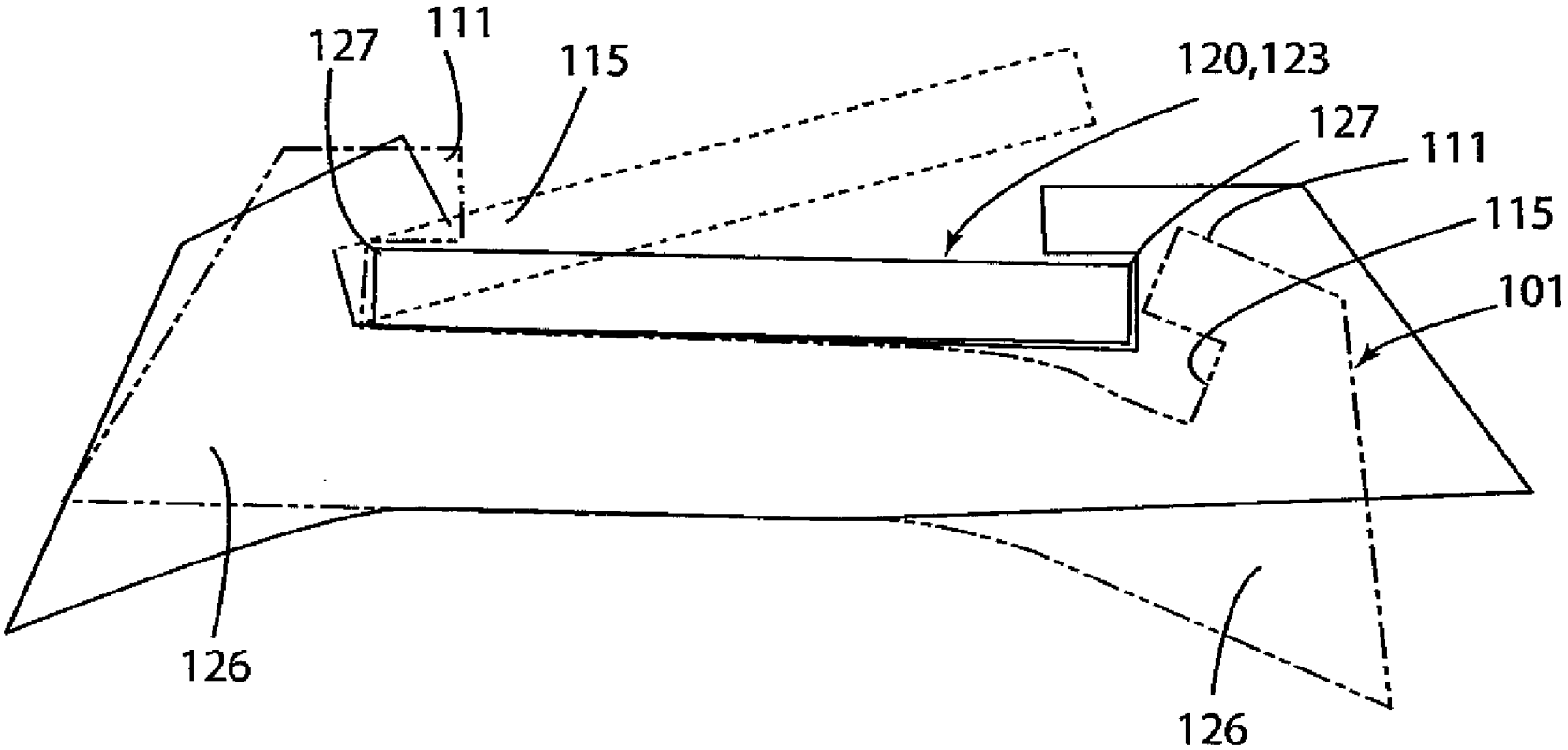
FIG. 12 is a partially schematic view showing flexing of the sander of FIG. 9 to install the sander to the head of a drywall sanding tool.

With further reference to FIG. 12, the sander 101 can be installed to a rectangular sander head 120 or plate 123 by flexing the edge portions 126 downwardly to permit insertion of edge portions 127 of head 120 or plates 123. The retaining tabs 110 can be flexed to permit insertion of end portions 128 of head 120 or plate 123 in substantially the same manner as just described for retaining tabs 111.

Figure 13:
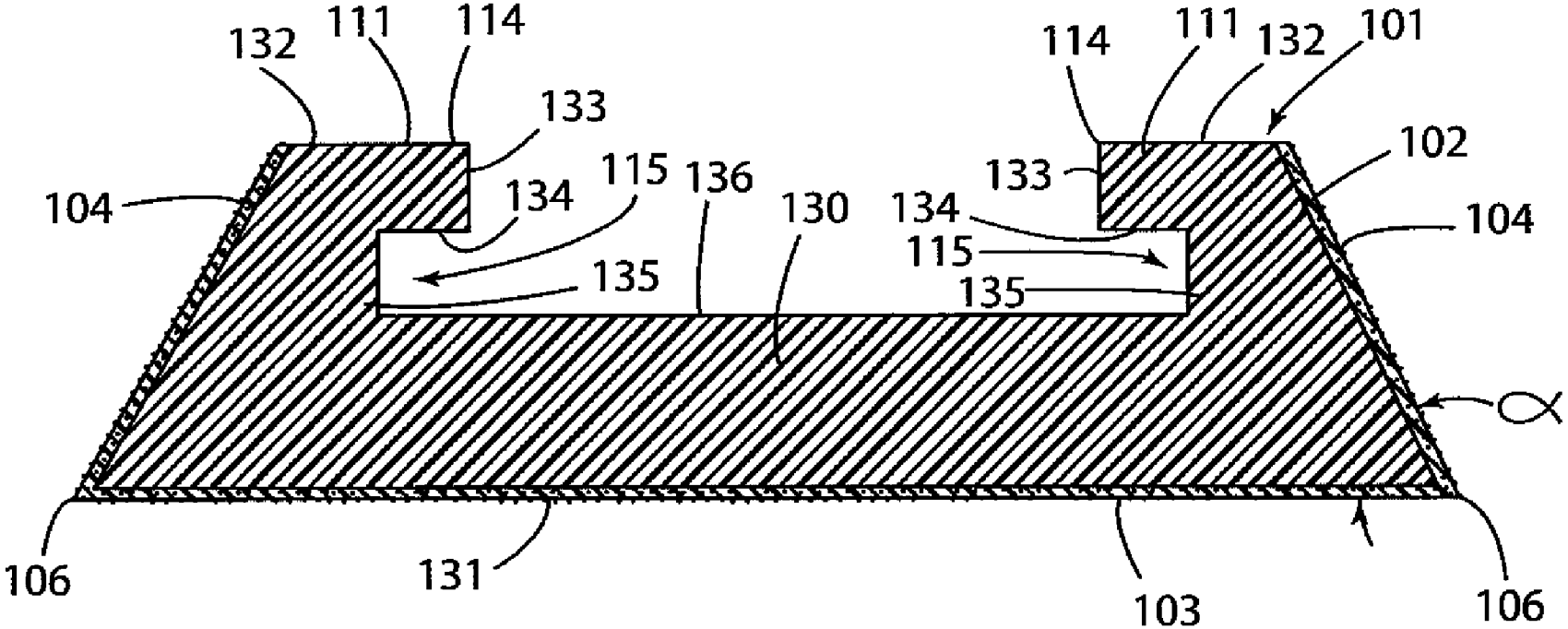
FIG. 13 is a cross-sectional view of the sander of FIG. 9 taken along the line XII-XII.
Figure 14:
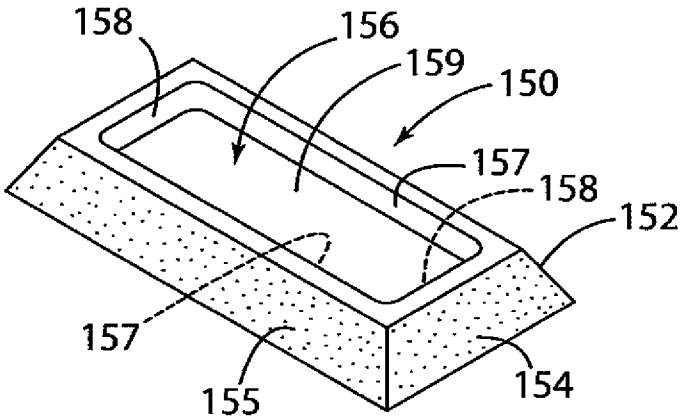
FIG. 14 is a perspective view of a sander according to another aspect of the present invention.
Figure 17:
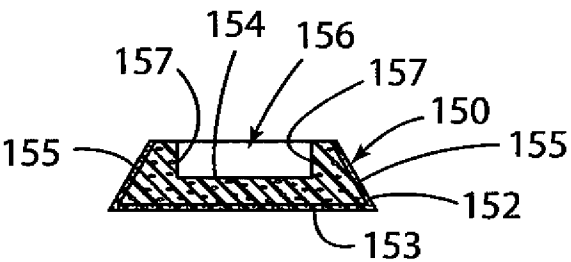
FIG. 17 is a cross-sectional view of the sander of FIG. 16 taken along the line XVII-XVII.
Figure 15:
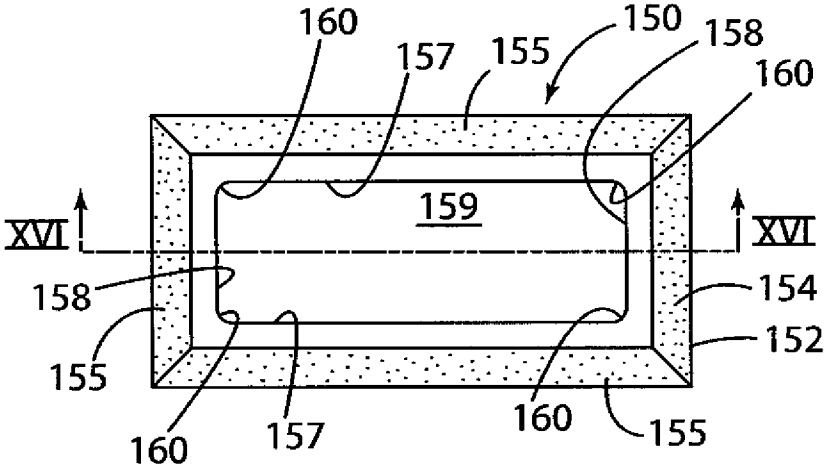
FIG. 15 is a plan view of the sander of FIG. 14.
Figure 16:
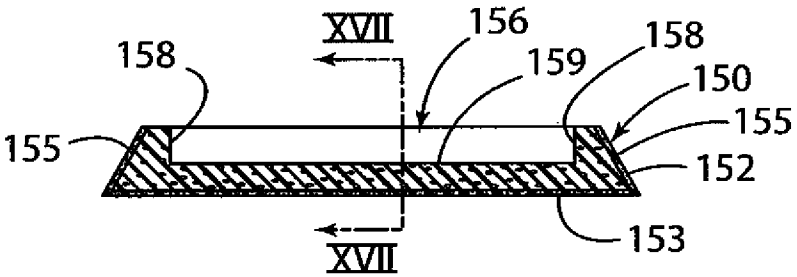
FIG. 16 is a cross-sectional view of the sander of FIG. 15 taken along the line XVI-XVI.

With reference to FIG. 13, the body 102 includes a foam core 130 with an abrasive material such as sandpaper adhered or otherwise fixed to the main surface 3 and side surfaces 4 and 5. The surfaces may also be covered or coated with an abrasive material such as granular material 131. The other surfaces 132-136 may also be covered with sandpaper or abrasive material 131.

The sander 101 can be quickly and easily attached to a variety of commercially available drywall sanders. The angled side surfaces 4 and 5 permit sanding in corners and the like having limited access. Also, because the foam is somewhat flexible, the retaining tabs 110 and 111 will retain the sander 101 on a variety of drywall sanders of somewhat different configurations. Also, the flexibility of the foam material allows the sander 101 to sand irregular, non-planar surfaces having concave and/or convex portions. For example, commercially available drywall sander heads 120 (FIG. 11) may include a layer of foam 119 for use with conventional sandpaper. However, the foam 119 may deteriorate and become uneven or detach from the head 20. The retaining tabs 110 and 111 are configured to provide sufficient grip to retain the sander 101 on a head 120 regardless of whether or not a layer of foam 119 is present.

With reference to FIGS. 14-17, a sander 150 according to yet another aspect of the present invention includes a body 52 having angled surfaces 154 and 155, and a main surface 153. The body 152 is made of a foam material, and the outer surfaces of the body 102 are covered with an abrasive material in substantially the same manner as described above in connection with the sander 101.

Sander 150 includes a cavity 156 having sidewalls 157 and 158, and a flat base surface 159. The cavity 156 may include corners 60 that are radiused as shown (e.g., FIG. 15), the corners 60 may be a sharp corner (not shown).

Figure 18:
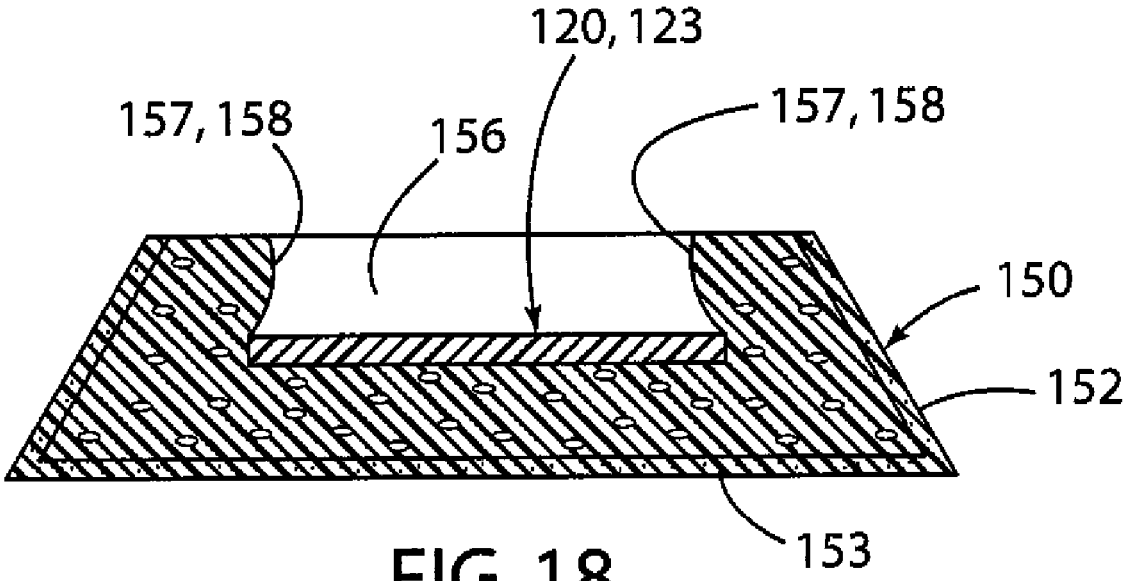
FIG. 18 is a cross-sectional view of the sander of FIG. 14, showing the sander connected to a sander head.

Sander 150 is secured to a sanding head 20 or plate-like portion 123 (FIG. 11) by inserting the head 120 or plate-like portion 123 into the cavity 156. As shown in FIG. 18, when the head 110 or plate-like portion 123 is inserted into the cavity 156, the foam material of the body 152 deforms, thereby retaining the sander head in the cavity 156. It will be understood that the dimensions (i.e., distance between sidewalls 157, and the distance between sidewalls 158) are preferably somewhat smaller than the dimensions of the head 120 or plate-like portion 123 to thereby retain the sander 150 to the head 120 or plate-like portion 123. Further, the sander 150 may include an undercut channel or slot extending around the sidewalls 157 and 158. When configured in this way, sander 150 has a cross-sectional shape that is substantially similar to the cross-sectional shape of sander 101 shown in FIG. 13.

The sander 150 may be quickly and easily attached to a variety of commercially available drywall sanders, and the sander 150 provides access to surfaces having limited access.

Sander 101 provides substantially the same advantages as sanding pad 10 described above. For example, the main surface 153 is substantially wider than the sanding head 120 and thereby forms wings that stabilize the sanding head to permit circular sanding motion and/or motion across the short dimension of the sanding head without flipping the sanding head over. Sander 101 also provides for sanding adjacent transverse surfaces in corners, around door frames, and the like, without marking or damage to the transverse surfaces.

In the foregoing description, it will be readily appreciated by those skilled in the art that modifications may be made to the invention without departing from the concepts disclosed herein. Such modifications are to be considered as included in the following claims, unless these claims by their language expressly state otherwise.

The invention claimed is:

1. A combination sanding pad and drywall sander, comprising:

a drywall sander including a drywall sander head having upper and lower opposite side faces, and first and second pairs of opposite edge surfaces extending around the opposite side faces and defining a generally quadrilateral perimeter:

the sanding pad comprising:

a body portion comprising a resiliently deformable core material, the body portion defining a generally planar first side surface having a generally quadrilateral perimeter, the body portion defining a second side that faces opposite the first side surface, the second side including a second side surface;

abrasive material disposed on at least a portion of the first side surface; and wherein:

the body portion includes a generally quadrilateral pocket in the second side, the pocket having a first pair of opposing side surfaces generally facing one another, and a second pair of opposing side surfaces generally facing one another, and a base surface extending between the first and second pairs of opposing side surfaces, wherein the base surface is spaced inwardly from the second side surface, and wherein the drywall sander head is disposed in the pocket with at least a portion of the lower side face in contact with the base surface, and with the first and second pairs of opposite edge surfaces of the drywall sander head in contact with the first and second pairs of opposing side surfaces, respectively, of the pocket in the body of the sanding pad, and wherein portions of the sanding pad wrap around the first and second pairs of opposite edge surfaces and retain the sanding pad on the drywall sander head.

2. The combination sanding pad and drywall sander of claim 1, wherein:

the first and second pairs of opposing side surfaces are resiliently deformable whereby a drywall sander head can be inserted into the pocket to deform the first and second pairs of opposing side surfaces.

3. The combination sanding pad and drywall sander of claim 1, wherein:

the first side surface defines a first length and a first width;

the second side surface defines a generally quadrilateral perimeter having a second length that is substantially less than the first length, and a second width that is substantially less than the first width.

4. The combination sanding pad and drywall sander of claim 3, wherein:

the body portion includes four generally planar outer side surfaces extending between the first and second side surfaces.

5. The combination sanding pad and drywall sander of claim 4, wherein:

at least a portion of each of the outer side surfaces comprise abrasive material.

6. The combination sanding pad and drywall sander of claim 5, wherein:

each of the outer side surfaces define a perimeter having the shape of an isosceles trapezoid.

7. The combination sanding pad and drywall sander of claim 1, wherein:

the first and second pairs of opposing side surfaces are substantially planar.

8. The combination sanding pad and drywall sander of claim 7, wherein:

the first and second pairs of opposing side surfaces comprise resiliently deformable core material.

9. The combination sanding pad and drywall sander of claim 8, wherein:

the resiliently deformable core material comprises foam, wherein at least a portion of the foam is exposed.

10. A sanding pad for attachment to a drywall sander of the type having edge portions forming a generally quadrilateral perimeter, the sanding pad comprising:

a body portion having first and second opposite sides, the body portion comprising a core made of a resiliently deformable material, the body portion having a generally planar first sanding surface on the first opposite side of the body portion, the first sanding surface having edges that define a generally quadrilateral perimeter, the sanding pad defining an axis that is perpendicular to the first sanding surface;

the sanding pad further comprising an integral connector adapted to connect the sanding pad to a drywall sander having a quadrilateral perimeter, wherein the integral connector comprises retaining portions of the body portion extending approximately parallel to the axis when the retaining portions are in a free state, and wherein the retaining portions are spaced-apart to define a drywall sander-receiving pocket, whereby the retaining portions can be moved outwardly from the free state to permit insertion of a portion of a drywall sander into the pocket, such that the retaining portions engage edge portions of a drywall sander to retain the sanding pad on the drywall sander without clamping of the sanding pad.

11. The sanding pad of claim 10, wherein:

the retaining portions comprise four connecting structures formed integrally with the core of the body portion.

12. The sanding pad of claim 11, wherein:

each connecting structure includes a groove facing the drywall sander-receiving pocket.

13. The sanding pad of claim 12, wherein:

the connecting structures are spaced-apart to form four gaps adjacent corners of the perimeter of the first sanding surface.

14. The sanding pad of claim 10, wherein:

the drywall sander-receiving pocket is generally quadrilateral in shape.

15. The sanding pad of claim 14, wherein:

the retaining portions are integrally formed with one another to define continuous inner surfaces extending around the drywall sander-receiving pocket.

16. The sanding pad of claim 15, wherein:

the continuous inner surfaces are generally planar when the retaining portions are in a free state.

17. The sanding pad of claim 16, wherein:

the body portion includes a base surface extending between the continuous inner surfaces, and an outer surface on the second side of the body portion that is generally parallel to the first sanding surface, and wherein the continuous inner surfaces extend parallel to the axis from the base surface to the outer surface.

18. The sanding pad of claim 17, wherein:

the outer surface comprises a quadrilateral outer perimeter, and a quadrilateral inner perimeter, wherein the inner perimeter is defined by an edge formed at the intersection of the outer surface with the continuous inner surfaces.

19. The sanding pad of claim 15, wherein:

the continuous inner surfaces are resiliently deformable.

20. A sanding pad for attachment to a drywall sander head of the type having a generally quadrilateral perimeter, the sanding pad comprising:

a body portion comprising a resiliently deformable core material, the body portion defining a generally planar first side surface having a generally quadrilateral perimeter, the body portion defining a second side that faces opposite the first side surface, the second side including a second side surface;

abrasive material disposed on at least a portion of the first side surface; and wherein:

the body portion includes a generally quadrilateral pocket in the second side, the pocket having a first pair of opposing side surfaces generally facing one another, and a second pair of opposing side surfaces generally facing one another, and a base surface extending between the first and second pairs of opposing side surfaces, wherein the base surface is spaced inwardly from the second side surface.

21. The sanding pad of claim 20, wherein:

the first pair of opposing side surfaces and the base surface together define a T-shaped gap in a first cross section; and the second pair of opposing side surfaces and the base surface together define a T-shaped gap in a second cross section taken orthogonal to the first cross section.

22. The sanding paid of claim 20, including:

a drywall sander head having first and second opposite side faces and edge surfaces extending around peripheral edges of the first and second opposite side faces to define a rectangular perimeter; and the base surface is planar, and the first and second pairs of opposing side surfaces are planar and extend from the base surface to the second side surface such that the cavity is U-shaped in first and second cross sections that are orthogonal to one another.

23. The sanding pad of claim 20, wherein:

the first side surface has a first rectangular perimeter, and the second side surface has a second rectangular perimeter that is significantly smaller than the first rectangular perimeter, the body portion further including four planar outer side surfaces extending between the first and second side surfaces, and wherein each of the outer side surfaces defines a perimeter having the shape of an isosceles trapezoid.

* * * * *